United States Patent [19]

Bowlus et al.

[11] 4,271,537

[45] Jun. 9, 1981

[54] PROTECTIVE HELMET WITH RELEASABLE FACE GUARD APPARATUS

[75] Inventors: Burton R. Bowlus, El Dorado; Gerald L. McKinney, Newton, both of Kans.

[73] Assignee: Wichita Pro-Tech Inc., Newton, Kans.

[21] Appl. No.: 38,652

[22] Filed: May 14, 1979

[51] Int. Cl.[3] ..... A42B 1/08

[52] U.S. Cl. ..... 2/424; 2/9

[58] Field of Search ..... 2/9, 424, 425, 411, 2/412, 413, 414, 415, 410, 10

[56] References Cited

U.S. PATENT DOCUMENTS

| | | | |
|---|---|---|---|
| 3,353,187 | 11/1967 | Lastnik et al. | 2/412 |
| 3,854,146 | 12/1974 | Dunning | 2/9 |
| 3,889,296 | 6/1975 | Martin | 2/9 |
| 3,925,821 | 12/1975 | Lewicki | 2/425 |
| 4,028,743 | 6/1977 | Christensen | 2/9 X |

*Primary Examiner*—Peter P. Nerbun

[57] ABSTRACT

This invention is a protective helmet with releasable face guard apparatus that resembles a football helmet having considerable shock absorbing thickness and a face shield member that is releasably connected to the helmet. More particularly, the protective helmet with releasable face guard apparatus includes a basic helmet assembly with a face guard assembly connected thereto. The basic helmet assembly includes a main helmet body with an outer cover layer thereon. The main helmet body is constructed of a rigid foam shock absorbing material of substantial thickness such as two inches. The face guard assembly includes the face shield member mounted in a resilient connector assembly which is connected to the main helmet body. The resilient connector assembly acts as a shock absorber when the face shield member is pushed inwardly. Conversely, when the face shield member is grasped and pulled outwardly under sufficient force, the face shield member is released from the resilient connector assembly and main helmet body to prevent injury to the wearer thereof.

10 Claims, 3 Drawing Figures

PROTECTIVE HELMET WITH RELEASABLE FACE GUARD APPARATUS

PRIOR ART

Numerous types of protective headgear were noted in the prior art. The following United States Patents Nos. were noted in a search of the prior art:

2,793,366; 4,028,743; 3,849,801; 3,992,721; 3,568,210; 3,551,911; 4,042,974.

The use of an inner sizing liner in an outer helmet structure is set forth in several of the prior art patents.

The Rhee patent discloses the use of an energy absorbing helmet having a resilient foam means covered with a tough pliable surface coating.

The Christensen patent teaches the use of protective head-wear with various types of face shields mounted thereon.

However, it is our opinion that none of the patents teach the combination of (1) a thick foam, totally enclosed main helmet body; (2) a resilient connector assembly of varying shock absorbing characteristics mounted in the main helmet body; and (3) a face shield member mounted in the resilient connector assembly and operable to be released therefrom on sufficient outward pulling force applied thereto.

PREFERRED EMBODIMENT OF THE INVENTION

The invention herein is a protective helmet with releasable face guard apparatus including (1) a basic helmet assembly; (2) a liner sizing assembly mounted inside the basic helmet assembly; (3) a face guard assembly connected to the basic helmet assembly; and (4) a conventional chin strap assembly connected to the basic helmet assembly and operable in a standard manner. The basic helmet assembly resembles a football helmet having a main helmet body covered with an outer cover layer. However, the main helmet body is constructed of a thick, shock absorbing rigid foam material. A forward portion of the main helmet body is formed with an elongated guard receiving slot section to receive the face guard assembly therein. The liner sizing assembly comes in various thickness to properly size the main helmet body to the size of a person's head using same. The face guard assembly includes a face shield member mounted in a resilient connector assembly. The face shield member includes a main connector section integral with a nose guard section and a mouth guard section. The resilient connector assembly resembles an elongated rubber strap that is mounted in the guard receiving slot section in the main helmet body. The resilient connector assembly includes a main body member; a shield receiving hole in the main body member extend the length thereof; and a shield access slot extended into the shield receiving hole and the length thereof. The main body member is constructed of integral layers of a rubber material varying in density to achieve the desired shock absorbing characteristics. The main connector section of the face shield member is inserted through the shield access slot and placed in the shield receiving hole in the main body member. Then, on excessive outward pulling force on the face shield member, the main connector section moves outwardly through the shield access slot to be released therefrom. This achieves the releasable face guard or shield member function of this invention.

OBJECTS OF THE INVENTION

One object of this invention is to provide a protective helmet with releasable face guard apparatus that is constructed of a thick shock absorbing foam material so as to provide the maximum protection to the wearer thereof.

Another object of this invention is to provide a protective helmet with releasable face guard apparatus having a basic helmet assembly with a face guard assembly connected thereto, the face guard assembly has a face shield member which is releasable from the basic helmet assembly on a predetermined outward pull force thereon.

One further object of this invention is to provide a protective helmet with releasable face guard apparatus including a face guard assembly with a face shield member mounted in a resilient connector assembly to provide new and novel shock absorbing characteristics.

One other object of this invention is to provide a protective helmet with releasable face guard apparatus including a basic helmet assembly constructed of a thick rigid, shock absorbing foam material adapted to receive an inner liner sizing assembly therein of a foam material to achieve a maximum of shock absorbing characteristics by this invention.

Still, another object of this invention is to provide a protective helmet with releasable face guard apparatus that is attractive in appearance, presents maximum shock absorbing characteristics, prevents injuries by utilizing a releasable face shield member, and being economical to manufacture.

Various other objects, advantages, and features of the invention will become apparent to those skilled in the art from the following discussion, taken in conjunction with the accompanying drawings, in which:

FIGURES OF THE INVENTION

Figure 1:
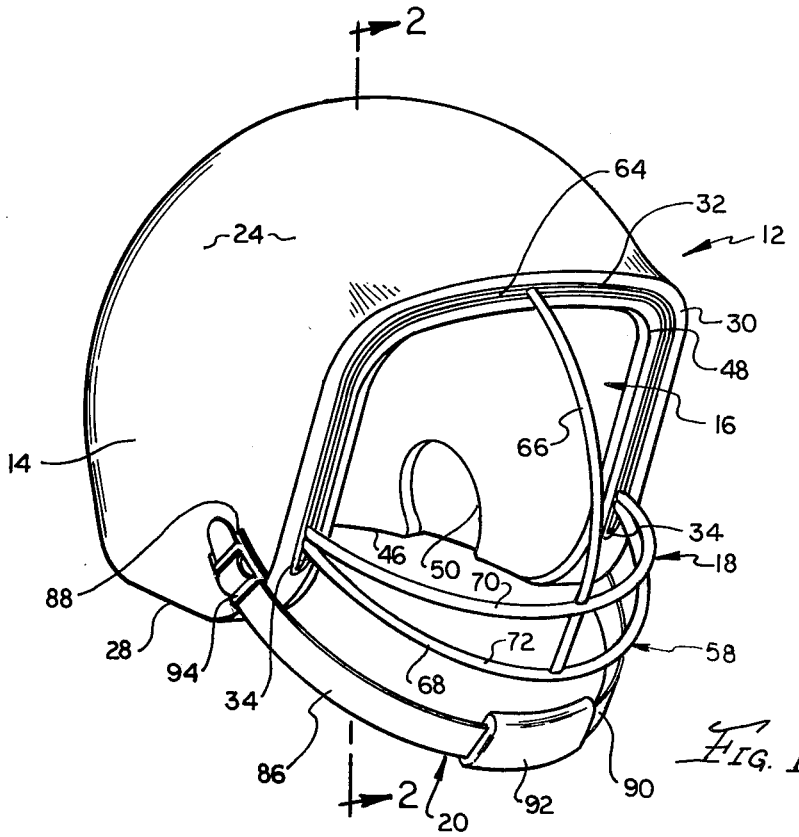
FIG. 1 is a perspective view of the protective helmet with releasable face guard apparatus of this invention.

The following is a discussion and description of preferred specific embodiments of the new protective helmet with releasable face guard apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and in particular to FIG. 1, the protective helmet with releasable face guard apparatus of this invnetion, indicated generally at 12, includes (1) a basic helmet assembly 14 which resembles a football helmet; (2) a liner sizing assembly 16 mounted within the basic helmet assembly 14; (3) a face guard assembly 18 connected to the basic helmet assembly 14; and (4) a chin strap assembly 20 connected to the basic helmet assembly 14. The basic helmet assembly 14 includes a main helmet body 22 adapted to cover a person's head having its outer surface coated with an outer cover layer 24.

The main helmet body 22 has the shape and contour of a football helmet and includes a contoured shell member 26 having a neck cutout section 28 joining a frontal face cutout section 30 plus a guard receiving slot section 32 in the frontal face cutout section 30. The main helmet body 22 has no exterior openings such as for ear hearing holes.

The contoured shell member 26 is constructed of a foam material having substantial shock absorbing characteristics. The shell member 26 is constructed from 1½ inches thick to 2½ inches thick within the preferred embodiment being 2 inches thick.

The shell member 26 is a unitary member constructed of a rigid polystyrene or polyurethane foam. The use of a rigid rather than a flexible foam material has proven most satisfactory and preferred. The shell member 26 can be dented with sufficient force applied thereto which shock is distributed throughout the structures.

As best shown in FIG. 1, the guard receiving slot section 32 is of a generally U-shape and opened at lower ends indicated at 34 for reasons to be explained. The guard receiving slot section 32 is to receive a portion of the face guard assembly 18 therein.

Figure 3:
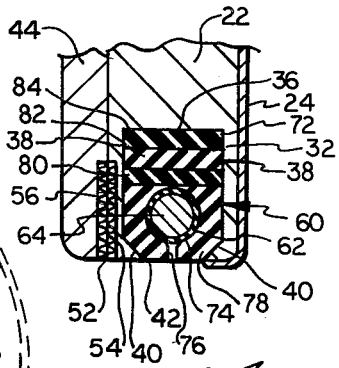
FIG. 3 is an enlarged fragmentary sectional view taken along line 3—3 in FIG. 2.

As shown in FIG. 3, the guard receiving slot section 32 is of generally rectangular shape in transverse cross section having an inner wall 36, parallel sidewalls 38, and opposed inclined front walls 40 is an access opening 42 for reasons to become obvious.

The outer cover layer 24 applied to the outer surface of the contoured shell member 26 can be of any desired color and presents a high gloss surface. The preferred cover layer 24 is a material called "Senotex" manufactured by the Fuller Company of Minneapolis, Minn. The material is a urethane plastic which bonds to the shell member 26 and presents a smooth, shiny coating.

The liner sizing assembly 16 conforms in shape to the inside of the main helmet body 22 and includes a contoured shell section 44 with a neck cutout surface 46; a frontal face cutout section 48; and opposed ear cutout sections 50. The contoured shell section 44 is constructed of various thickness and acts as a spacer between the wearer's head and the main helmet body 22. This allows the main helmet body 22 to be constructed of one size to be used with a selected one of the liner sizing assemblies 16.

The face guard assembly 18 includes a face shield member 58 connectable to a resilient connector assembly 60 which, in turn, is mounted in the guard receiving slot section 32 in the main helmet body 22. The face shield member 58 is of a tubular rod construction having an outer plastic coating 62 bonded thereto.

More particularly, the face shield member 58 includes a main connector section 64 of generally U-shaped; a nose guard section 66 having one end connected to the main connector section 64; and a mouth guard section 68 connected to (1) lower outer ends of the main connector section 64 and (2) the nose guard section 66. The mouth guard section 68 includes a horizontal, upper guard portion 70 and an inclined lower guard portion 72.

The resilient connector assembly 60 resembles an elongated rubber strip to be mounted in the guard receiving slot section 32 in the contoured shell member 26. For assembly, one end of the resilient connector assembly 60 is inserted into an open lower end 34 of the guard receiving slot section 32 and pulled the length thereof to appear as shown in FIG. 1.

As seen in FIG. 3, the resilient connector assembly 60 is the same shape in transverse cross section as the guard receiving slot section 32 so as to fit snugly therein. The resilient connector assembly 60 includes a main body member 72; a shield receiving hole 74 extended the length of the main body member 72; and a shield access slot 76 providing entrance into the entire length of the shield receiving hole 74.

The main body member 72 is constructed of an integral shock absorbing rubber material being of a layered construction including (1) a first shield receiving section 78; (2) a first shock section 80; (3) a second shock section 82; and (4) a third shock section 84 and the density of the rubber material increases from item (1) to item (4). The main body member 72 is preferably constructed of a synthetic rubber or vinyl material.

The density of the first shield receiving section 78 is such as to allow positioning of the main connector sections 64 of the face shield member 58 in the shield receiving hole 74 as shown in FIGS. 1 and 3. It is obvious that the main connector section 64 can be moved outwardly of the shield receiving hole 74 through the shield access slot 76 in a manner to be described. Also, the density of the first shield receiving section 78 can be controlled so that a specific outward pulling force is required before release of the face shield member 58 from the resilient connector assembly 60.

The first, second, and third shock sections 80, 82, and 84 act as a shock absorber when force is applied against the face shield member 58 toward the basic helmet assembly 14. The first shock section 80 is of a density greater than the first shield receiving section 78 and provides the first stage of compression.

Next, the second shock section 82 is of a density greater than the first shock section 80 and provides a second stage of compression.

Finally, the third shock section 84 is of a density greater than the second section 82 and provides a third and final stage of compression.

Therefore, it is obvious that the first, second, and third shock sections 80, 82, and 84 provides a progressive or stepped shock absorbing characteristic when inward force is applied to the face shield member 58.

As shown in FIG. 1, the chin strap assembly 20 is of a conventional nature including a chin strap member 86 with connector members 88 connected to outer ends thereof. The chin strap member 86 includes a strap member 90 with a chin cushion member 92 mounted thereon.

The connector members 88 can be of a snap button or of the velcro material type. Each connector member 88 has an adjustment member 94 to bring the chin strap assembly 20 to the proper size for a person utilizing same.

USE AND OPERATION OF THE INVENTION

As shown in FIG. 1, the protective helmet with releasable face guard apparatus 12 is illustrated in the assembled condition with the liner sizing assembly 16; the face guard assembly 18; and the chin strap assembly 20 all connected to the basic helmet assembly 14. The overall appearance is similar to a conventional football helmet except the basic helmet assembly 14 is preferrably two inches thick and constructed of a shock absorbing foam material such as rigid polystrene or polyurethane which is an important feature of this invention.

The liner sizing assembly 16 comes in various thickness so as to adapt the basic helmet assembly 14 to varying head sizes. The connector assembly 52 permits easy replacement of the shell section 44 to change sizes or for repair and maintenance.

The face guard assembly 18 in the usage condition of FIG. 1 has the face shield member 58 mounted in the resilient connector assembly 60. More particularly, as shown in FIG. 3, the main connector section 64 of the face shield member 58 is enclosed by the first shield receiving section 78 of the main body member 72. The density of the rubber in the first shield receiving section 78 is selected to require a predetermined force to move the face shield member 58 outwardly as shown by an arrow 96 in FIG. 2.

The releasability feature of the face shield member 58 of this invention is very important to prevent twisting and injury to the head and neck portions of the persons wearing same.

Figure 2:
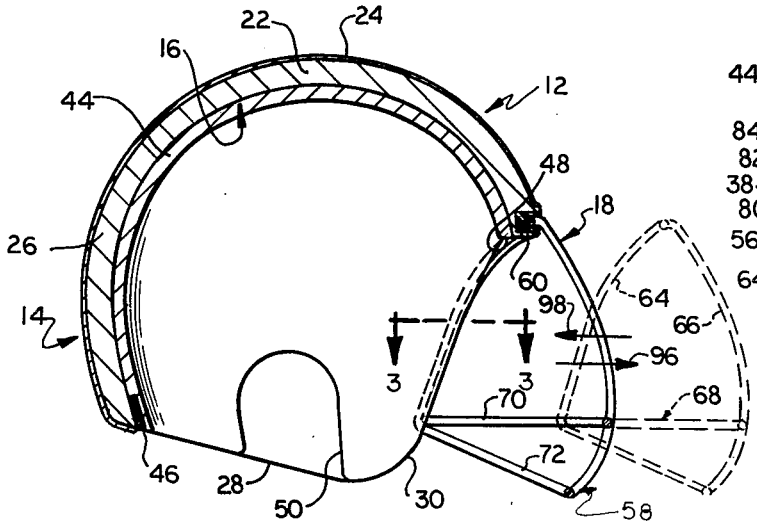
FIG. 2 is a sectional view taken along line 2—2 in FIG. 1 without a chin strap assembly and illustrating a released face shield member in dotted lines.

Another important feature of this invention is the shock absorbing characteristics of the main body member 72 of the resilient connector assembly 60 when force is applied against the face shield member 58 as shown by an arrow 98 in FIG. 2. The density of the integral rubber material increases from the first shock section 80 to the second shock section 82 to the third shock section 84 to achieve the shock absorbing characteristics of the face guard assembly 18.

The protective helmet with releasable face guard apparatus of this invention provides a soft type football type helmet with the thick foam material absorbing shocks applied thereto. The helmet may be dented but can be easily repaired at low cost to its original condition. The face guard assembly is important to (1) absorb shocks applied thereagainst, and (2) release the face shield on application of a sufficient outward pulling force thereon.

While the invention has been described in conjunction with preferred specific embodiments thereof, it will be understood that this description is intended to illustrate and not to limit the scope of the invention, which is defined by the following claims.

I claim:

1. A protective helmet apparatus usable as a football helmet or the like to be worn by a person, comprising:

(a) a basic helmet assembly including a main helmet body;

(b) said main helmet body having a contoured shell member to conform to the general outline of a person's head;

(c) said shell member constructed of a continuous, thick, rigid foam material without any openings thereto except for the person's neck and face portions;

(d) a face guard assembly having a face shield member releasably mounted in a resilient connector assembly which, in turn,, is mounted in said shell member;

(e) said face shield member includes a main connector section of generally U-shape and fits into said resilient connector section which is also of generally U-shape mounted in said shell member about said opening for the person's face portion; and (f) said face shield member is released from said connector assembly on a predetermined outward pulling force thereon as a safety factor to the person wearing same.

2. A protective helmet apparatus as described in claim 1, wherein:

(a) said connector assembly having a shock section between said face shield member and said shell member to absorb the shock of inward impact force against said face shield member; and (b) said shock section constructed of a plurality of integral rubber layers to provide progressive shock absorbing characteristics.

3. A protective helmet apparatus as described in claim 1, wherein:

(a) said connector assembly includes a main body member, a shield receiving hole in said main body member to receive a portion of said face shield member therein, and a shield access slot connected to said shield receiving hole to permit entrance and exit of said portion of said face shield member thereto.

4. A protective helmet apparatus as described in claim 3, wherein:

(a) said main body member constructed of an integral rubber material in layers with an outer first shield receiving section having said shield receiving hole therein; a first shock section integral with said first shield receiving section; a second shock section integral with said first shock section; and a third shock section integral with said second shock section.

5. A protective helmet apparatus as described in claim 4, wherein:

(a) said first, second, and third shock sections being progressively of greater density for shock absorbing characteristics.

6. A protective helmet apparatus usable as a football helmet or the like to be worn by a person, comprising:

(a) a basic helmet assembly having a contoured shell member to conform to the general outline of a person's head;

(b) a face guard assembly having a face shield member releasably mounted in a connector assembly which, in turn, is mounted in said shell member;

(c) said face shield member is released from said connector assembly on a predetermined outward pulling force thereon as a safety factor to the person wearing same;

(d) said connector assembly being resilient having a shock section between said face shield member and said shell member to absorb the shock of inward impact force against said face shield member; and (e) said shock section constructed of a plurality of integral rubber layers of increasing density to provide progressive shock absorbing charaeteristics.

7. A protective helmet apparatus as described in claim 6, wherein:

(a) said connector assembly includes a main body member, a shield receiving hole in said main body member to receive a portion of said face shield member therein, and a shield access slot connected to said shield receiving hole to permit entrance and exit of said portion of said face shield member thereto;

(b) said main body member constructed of an integral rubber material in layers with an outer first shield receiving section having said shield receiving hole therein; a first shock section integral with said first shield receiving section; a second shock section integral with said first shock section; and a third shock section integral with said second shock section; and (c) said first, second, and third shock sections being progressively of greater density for shock absorbing characteristics.

8. A protective helmet apparatus usable as a football helmet or the like to be worn by a person, comprising:

(a) a basic helmet assembly including a main helmet body;

(b) said main helmet body having a contoured shell member to conform to the general outline of a person's head;

(c) said shell member constructed of a continuous, thick, rigid foam material without any openings thereto except for the person's neck and face portions;

(d) a face guard assembly having a face shield member releasably mounted in a connector assembly which, in turn, is mounted in said shell member;

(e) said face shield member is released from said connector assembly on a predetermined outward pulling force thereon as a safety factor to the person wearing same;

(f) said connector assembly being resilient having a shock section between said face shield member and said shell member to absorb the shock of inward impact force against said face shield member; and (g) said shock section constructed of a plurality of integral rubber layers of increasing density to provide progressive shock absorbing characteristics.

9. A protective helmet apparatus as described in claim 8, wherein:

(a) said connector assembly includes a main body member, a shield receiving hole in said main body member to receive a portion of said face shield member therein, and a shield access slot connected to said shield receiving hole to permit entrance and exit of said portion of said face shield member thereto; and (b) said main body member constructed of an integral rubber material in layers with an outer first shield receiving section having said shield receiving hole therein; a first shock section integral with said first shield receiving station; a second shock section integral with said frist shock section; and a third shock section integral with said second shock section.

10. A protective helmet apparatus usable as a football helmet or the like to be worn by a person, comprising:

(a) a basic helmet assembly having a contoured shell member to conform to the general outline of a person's head;

(b) a face guard assembly having a face shield member releasably mounted in a connector assembly which, in turn, is mounted in said shell member;

(c) said face shield member is released from said connector assembly on a predetermined outward pulling force thereon as a safety factor to the person wearing same;

(d) said connector assembly being resilient having a shock section between said face shield member and said shell member; and (e) said shock section of increasing density from an outside surface to a back surface to provide progressive shock absorbing characteristics.

* * * * *